United States Patent [19]

Price

[11] Patent Number: 4,815,402

[45] Date of Patent: Mar. 28, 1989

[54] DUAL NEEDLE CONTROLLED NEEDLE TUFTING MACHINE

[75] Inventor: Herbert B. Price, Hixson, Tenn.

[73] Assignee: Spencer Wright Industries, Inc., Dalton, Ga.

[21] Appl. No.: 179,073

[22] Filed: Apr. 8, 1988

[51] Int. Cl.[4] ..... D05C 15/20

[52] U.S. Cl. ..... 112/80.44

[58] Field of Search ..... 112/80.43

[56] References Cited

U.S. PATENT DOCUMENTS 3,881,432 5/1975 Dodd et al. ..... 112/80.43 X 3,986,465 10/1976 Pembroke et al. ..... 112/80.43

*Primary Examiner*—Ronald Feldbaum

*Attorney, Agent, or Firm*—Alan Ruderman

[57] ABSTRACT

A tufting machine having a pair of rows of spaced apart needles which are independently selectively reciprocated in a path toward and away from a base material fed in a direction longitudinally from one row to the other through the machine. The machine includes drive mechanism including push rods which reciprocate during each cycle. A yoke is secured to each push rod and has a pair of downwardly depending limbs spaced apart longitudinally and corresponding to a respective row. The limbs for each row carry an air cylinder latching bar including latches which are controlled in accordance with a pattern. The needles are each carried by a respective needle holder mounted between the limbs and each needle holder may be coupled to the latch bar corresponding to that row selectively. Each needle in one row may be paired with a corresponding needle in another row aligned laterally across the machine and both needles in a pair may cooperate with a single looper, or the needles in one row may be laterally offset from the needles in the other row and each needle cooperates with one looper.

20 Claims, 2 Drawing Sheets

DUAL NEEDLE CONTROLLED NEEDLE TUFTING MACHINE

BACKGROUND OF THE INVENTION

This invention relates to tufting machines, and more particularly to a tufting machine having means for selecting one, two, both or neither needle to stitch a loop in accordance with a pattern, and which can effect a substantially smaller gauge between adjacent rows of stitches made by selectable or controlled needles then heretofore.

Controlled needle tufting machines are known in the art for selectively engaging and dispensing, in skip-stitch fashion, various of the needles in accordance with a program during each reciprocatory cycle of the needle driving push rods. Basically these machines render selective needles or groups of needles inoperative while the remainder of the needles are operative to pierce and penetrate the backing fabric upon each stroke of the push rods. Examples of these machines are illustrated in U.S. Pat. Nos. 3,115,856; 3,259,088; 3,881,432 and 3,986,465, and in Slattery copending application Ser. No. 07/140,480, filed on Jan. 4, 1988 and assigned to the same assignee as the present invention. Such machines have been very successful, especially for producing bed spreads, and in the case of individually controlled needle tufting machines have been widely accepted for overtufting a design into a pretufted fabric, as described in U.S. Pat. No. 4,693,190.

In these machines each needle cooperates with its own respective loop seizing hook and each hook cooperates with but one needle. However, although it is believed that sometime ago attempts were made to provide a tufting machine wherein one of two needles could be selected to sew with a single loop seizing member on a particular drive stroke or machine cycle, no such machine is known or believed to have been developed or constructed.

Additionally, the major limitation of individually controlled needle tufting machines has been the gauge or spacing between adjacent needles, i.e., the spacing between adjacent needles and thus between adjacent rows of stitches is larger than that which is desirable for a commercially aesthetic carpet. This is a direct result of the size of the needle bar and needle holders required for supporting the needles. For example although a 5/32nd gauge individual controlled needle (hereinafter "I.C.N.") machine has been constructed, the usual gauge is 3/16th and larger. Such machines, as aforesaid, have been widely accepted for overtufting a design into a pretufted carpet fabric wherein the base fabric has a finer gauge and the larger gauge I.C.N. is utilized for forming the design or pattern. Even for such overtufting operations greater design flexibility can be obtained if the gauge were smaller, such as 3/32nd gauge.

Furthermore, as noted in Bardsley copending application Ser. No. 07/123,258, filed Nov. 20, 1987 and assigned to the same assignee as the present application, if a controlled needle machine were developed wherein at least one of two needles could be selected to form a stitch in a given row of stitching, the needles could be threaded with different yarns, such as yarns of different color so that on any particular stitch the color could be selected. Although such a machine is disclosed in the aforesaid copending application of Bardsley, that machine does not have the capability of selecting both needles in a given row of stitching. Again, physical limitations in the machine there proposed preclude the versatility of selecting one or the other of the needles, neither needle and both needles. If both needles could be selected while still maintaining the capability of selecting one or the other of the needles, or neither needle, each needle could be threaded with a different color yarn to provide a multitude of patterning effects and color variations not heretofore possible in tufting machines to produce carpet fabric which heretofore could only be produced by the more costly weaving process on a loom. A controlled needle tufting machine having dual needles which may be individually controlled selectively to place one color yarn, or another color yarn, or neither yarn, or both yarns would provide a carpet designer with the freedom to perform creative and aesthetic designs having mass appeal at affordable cost. Moreover, the versatility of such a machine would be substantially increased if the gauge between adjacent needles could be varied to produce conventional I.C.N. products having half the gauge of the gauge between adjacent needles in a particular row thereof.

SUMMARY OF THE INVENTION

Consequently, it is a primary object of the present invention to provide a tufting machine having means for selecting one of two needles, or neither of the needles, or both of the needles, to cooperate with a loop seizing member to provide a single yarn, neither yarn, or both yarns in a base material in accordance with a pattern.

It is another object of the present invention to provide a tufting machine wherein one of two needles, or both needles, nor neither needle may be selected for piercing a base material substantially at a particular location in a single stitch line, the needle or needles so selected cooperating with a single loop seizing member.

It is a further object of the present invention to provide an individually controlled needle tufting machine wherein the gauge between adjacent stitches formed in a base material may be substantially reduced.

It is a still further object of the present invention to provide a tufting machine having the capability of being utilized to select one of two needles, neither of the needles, or both of the needles to cooperate with a loop seizing member in accordance with a pattern, and the capability of being utilized to change the gauge by moving one of the needles transverse to the direction of feed of the base material so that each needle may cooperate with a respective loop seizing member at a gauge substantially half of that of needles in each row of first and second needles.

Accordingly, the present invention provides a tufting machine having a pair of rows of spaced apart needles, the needles in the respective rows being independently selectively reciprocably driven in a path toward and away from a base material fed in the direction from one row to the other row or longitudinally through the machine into cooperation with a loop seizing member disposed beneath the base material for forming a loop of yarn when driven. Each needle in one row may have a corresponding needle in the other row aligned therewith on gauge laterally relatively to the direction of feed of the base material and a single loop seizing member may act to seize the yarn from one, none, or both needles selectively, or the needles in one row may be staggered laterally relatively to the needles in the other row and a loop seizing member may cooperate with each needle selectively to seize or not seize yarn from the respective needle.

The tufting machine includes a drive mechanism which reciprocates during each cycle of the machine and the needles in both rows are supported by respective needle holding means which may be latched selectively to the drive mechanism in accordance with a pattern. The drive mechanism includes a yoke having limbs spaced apart in the longitudinal direction from one row to the other row, each of the limbs supporting latch carrying means including selectively actuated latching means for the needles in the respective row. Guide support means mounted intermediate the limbs and intermediate laterally spaced yokes and guides, and supported thereby, together with the latch carrying means maintain the lateral disposition of the needle holding means. The needle holding means carry needle bars which in turn carry respective needles having elongated axes disposed in the direction from row to row intermediate the limbs so that a needle in one row and a corresponding needle in the other row may cooperate with a single loop seizing member. The latch carrying means and the guides for the needle holding means of one row may be adjustably mounted laterally so that the needle holding means and the needle supported thereby may be positioned in staggered relationship relative to the needle holding means and needles in the other row so that the stitching gauge is effectively reduced in half, and in this instance each needle has a corresponding loop seizing member.

When the needles in one row are aligned with needles in the other row, different yarns such as yarns of different colors, may be threaded into the corresponding needles of each row for selective loop seizing by the common loop seizing member. Thus, for example, a needle in one row may be threaded with a yarn of a first color and a corresponding needle in the other row may be threaded with a yarn of a second color, whereby the first color yarn, the second color yarn, both yarns or neither yarn may be seized by the common loop seizing member selectively.

When the needles in one row are staggered relative to the needles in the other row, the yarns may also be different, or the yarns may be the same, but the gauge between adjacent longitudinally extending stitches may be reduced to half that of conventional I.C.N. machines for producing finer gauge fabrics than heretofore possible on such conventional machines.

The present invention thus provides a tufting machine having the versatility and capability of producing a wide variety of patterned tufted fabrics. These fabrics may be overtufted fabrics and, for example, when the first and second rows are staggered, a number of colors may be tufted into the base material by threading the needles in one row with more than one color yarn and threading the needles in the other row with one or more other colors. In that case tufted fabric can be produced having a gauge equivalent to that currently produced, but with substantially more colors. However, if for example, the same number of colors as currently produced is desired, the gauge may be half of that currently produced. Another example of the use of the machine, while tufting at conventional gauge spacings, is the insertion into any particular location in the base material of one or two colors, both colors, or neither color selectively, a process which cannot now be performed by a tufting machine.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 2:
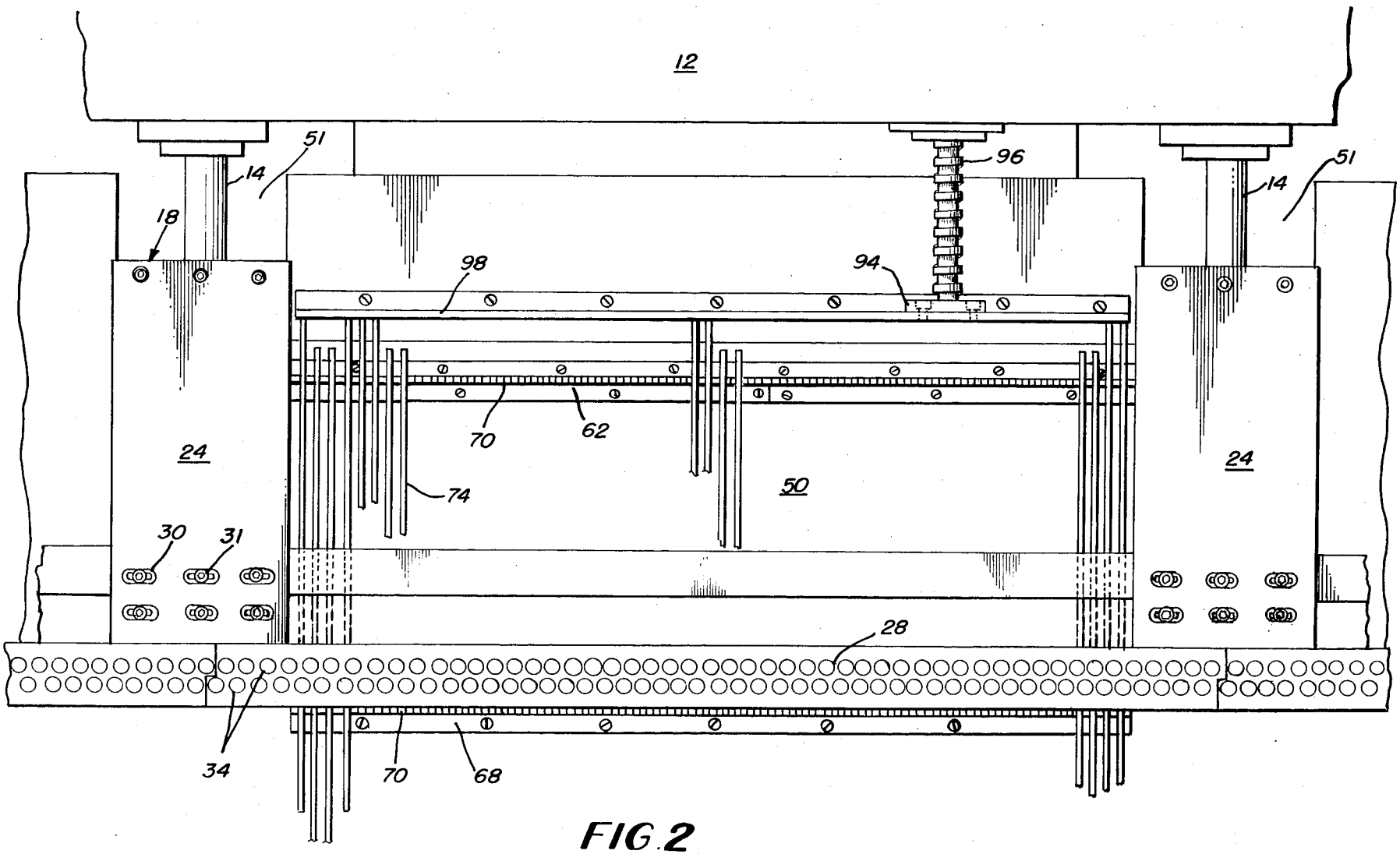
FIG. 2 is a fragmentary side elevational view of the machine illustrated in FIG. 1 with portions thereof broken away.

Referring to the drawings, a tufting machine 10 is illustrated constructed in accordance with the principles of the present invention. The machine includes a head 12 within which is mounted conventional drive mechanism for reciprocably driving a plurality of laterally spaced push rods 14, two of which are illustrated in FIG. 2, journalled for reciprocation in sleeves 16 mounted at the bottom of the head 12. The lateral direction is defined as transverse relative to the longitudinal direction in which a base material is being fed through the machine from the front to the rear thereof, as hereinafter described. The details of the drive mechanism within the head are not required for a disclosure of the present invention, but may be obtained from the disclosure in the aforesaid U.S. Pat. No. 3,881,432.

Adjacent the lower end of each push rod 14 is a yoke 18, the yoke having a substantially U-shaped configuration comprising a spanning member 20 clamped about and secured to the push rod, and a pair of downwardly depending limbs 22, 24 spaced apart in the direction from front to rear of the machine. Although the yoke may comprise a unitary member, for manufacturing purposes it is preferred that the limbs 22, 24 be separately formed and secured to the spanning member 20. A laterally elongated latch carrying bar 26 having a substantially L-shaped cross sectional configuration is adjustably connected to the lower end of the limbs 22, while a similar latch carrying bar 28 is adjustably connected to the lower ends of the limbs 24, the adjustable connection being by means of laterally elongated slots 30 through which bolts 31 extend and fasten the latch carrying bar to the respective limb so as to permit slight lateral adjustability.

Extending transversely to the axis of elongation through each of the latch carrying bars 26, 28 is a multiplicity of laterally spaced bores 32. The bores are preferably staggered in two vertically spaced rows so that laterally adjacent bores alternate between the vertical rows thereby to provide sufficient space so that each bore corresponds to a single needle for an I.C.N. tufting machine. Mounted within each bore 32 is a respective air cylinder 34, each cylinder having a respective plunger or latch pin 36. Each air cylinder 34 communicates through a respective flexible conduit 38 with a respective electrically controlled pneumatic valve 40. The valves 40 further communicate through respective conduits 42 with a single source of pressurized air such as compressor 44. The valves 40 are electrically controlled by a pattern control device 46 through electrical leads or the like 48, the pattern control 46 preferably being a computer driven control system loaded with pattern information from, for example, a floppy disk or the like prepared on separate pattern generation system. Consequently, as determined by the pattern control 46 each valve 40 may permit air to flow from the compressor to the respective cylinder 34 for extending the latch pin 36, or vent the valve. The pins 36 are biased to the retracted position so that when pressurized air is not supplied to the respective cylinder 36, the pin is in the retracted position and not extended.

Fixedly attached to the head 12 of the machine is a laterally extending downwardly depending support bracket 50. The bracket 50 may have spaced recesses 51 adjacent its upper end at the location of the push rods for providing a clearance for the lower ends of the push rods 14 as the push rods are reciprocated. In all other respects, the bracket 50 is an elongated plate-like member and the lower end thereof is disposed at an elevation proximate that of the bottom of the latch carrying air cylinder bars 26, 28 when the bars are in their lowermost disposition during the reciprocating cycle. Mounted in vertically spaced disposition at each side of the bracket 50 is a respective backing/guide support bar 52, 54 and 56, 58. Each of the bars 52, 54, 56, 58 is a laterally elongated metal member having an outer facing surface coated or having otherwise attached thereto a plasticised bearing material such as that sold under the tradename GARLOCK. Secured on the upper surface of each bar 52, 56 is a respective L-shaped guide 60, 62 while similar guides 64, 68 are fastened to the lower edges of the bars 54, 58 respectively. The guides 60, 62, 64, 68 preferably are brass members having laterally spaced guide slots 70. Disposed within the slots 70 in the respective pairs of guides 60, 64 and 62, 68 are respective vertically elongated bar shaped needle holders 72, 74, each needle holder 72, 74 fixedly carrying at its lower end a respective needle bar 76, 78 which in turn carry a respective needle 80, 82, through which yarn (not illustrated) is threaded conventionally. Each of the needle holders 72, 74 have respective recesses 77 for receiving a corresponding latch pin 36 when extended so as to be coupled to the respective latch bar 26, 28 for reciprocation therewith. The guide slots 70 act to position the needle holders laterally for alignment with the respective latch pin 36. Additionally, the needle holders 72, 74 may be guided by slots formed in the adjacent face of the latch carrying air cylinder bars 26, 28, and abut a surface of bearing material 84, 86 on a block 88, 90, carried on the respective latch bar 26, 28. The edge of the needle holders 72, 74 abut these surfaces and the bearing material on the face of the bars 52, 54 or 56, 58 so that each edge has a bearing surface while the needle holders are free to move up and down in the guides and guided laterally therein.

A laterally elongated stop bar 92, 94 at each side of the bracket 50 is supported by a plurality of respective lead screws 96 carried by a jack screw device (not illustrated) within the head 12 of the machine for purposes as described in the aforesaid U.S. Pat. No. 3,881,432 for limiting the maximum elevation of each of the needle holders 72, 74. A spring (not illustrated) corresponding to each needle holder conventionally may be attached at its upper end to a respective stop bar 92, 94 and to each of the respective needle bars 72, 74 to bias or urge the needle holders 72, 74 normally upwardly against the bottom of the respective stop bar 92, 94 to hold the unlatched needle holders in the raised position until they are latched as hereinafter described. However, it is preferred that, rather than utilize springs, the bottom surfaces of the stop bars 92, 94 carry a respective permanent magnet 97,98 for holding the tops of the respective carbon steel needle holders in the raised position until driven downwardly by the respective latch 36 when the latch is extended, the raised portion being adjacent to that where the needle holders are raised when the push rods are at top dead center.

The tufting machine conventionally includes a bed 100 disposed beneath the head 12. Mounted within the bed 100 is a multiplicity of loop seizing members such as loopers or hooks 102, 104 which oscillate in timed relationship to the reciprocation of the push rods to receive loops of yarn from one needle or an aligned pair of needles reciprocably driven when the respective needle holder or pair of needle holders is latched to the respective reciprocating latch carrying bar 26, 28. Conventially each hook 102, 104 preferably has a respective cooperating knife 106 acting in conjunction therewith so that loops seized by the hook may be cut to form cut pile. A backing material 108 is fed conventionally through the tufting machine by roller means 110, 112 over a needle plate 114 having spaced needle plate fingers 116, the needle plate being supported on an adjustable bed plate 118.

Figure 1:
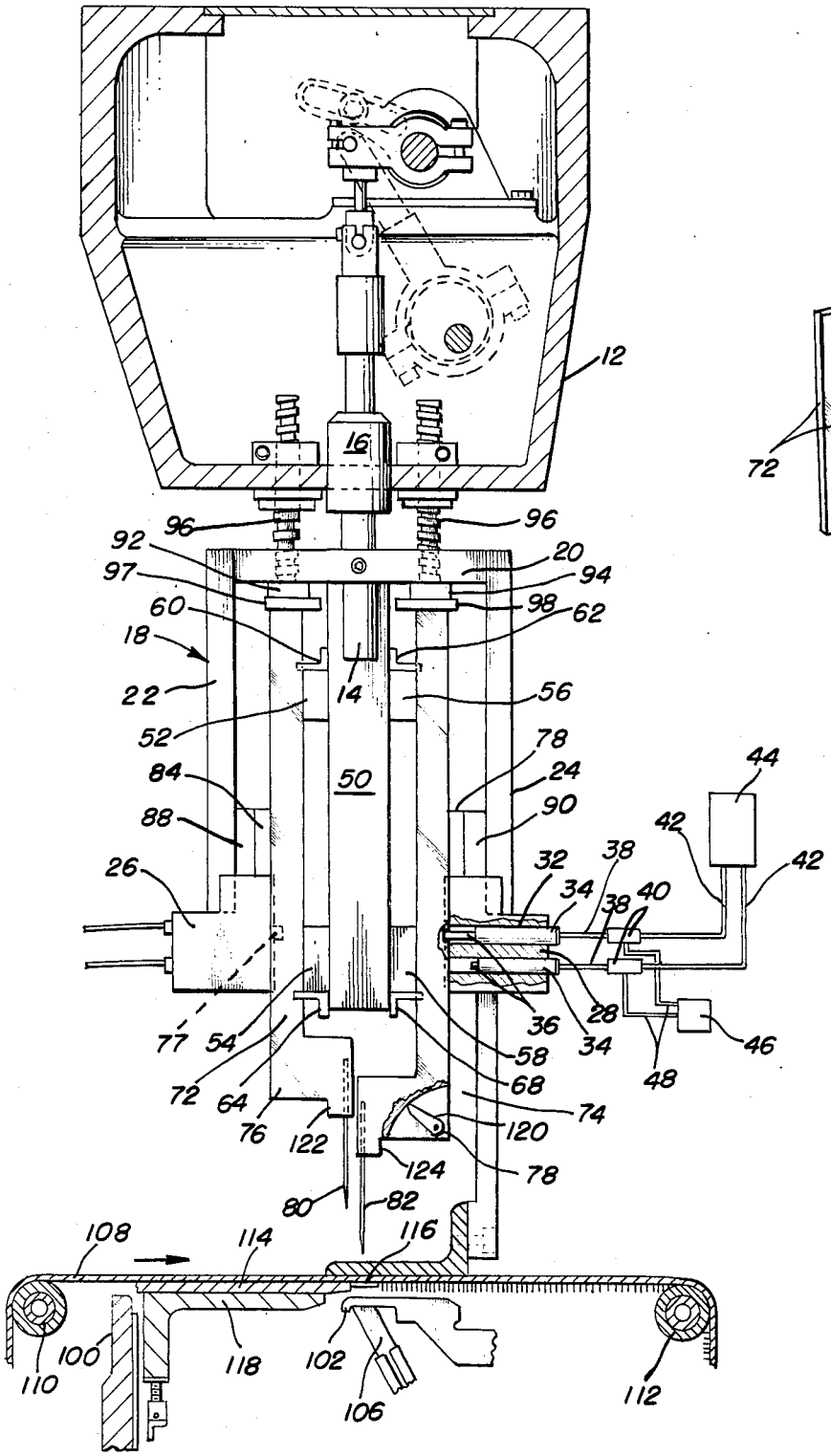
FIG. 1 is a fragmentary vertical cross sectional view taken substantially through a tufting machine constructed in accordance with the principles of the present invention.
Figure 3:
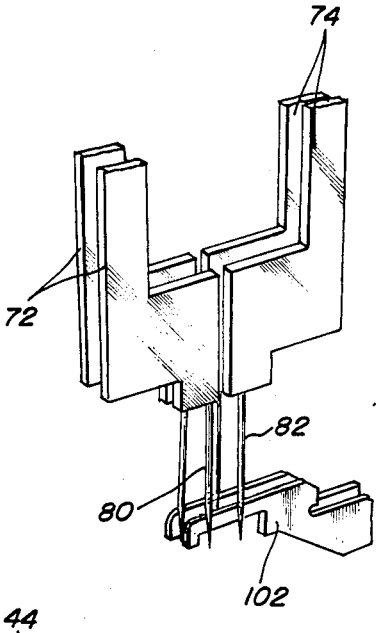
FIG. 3 is a fragmentary perspective view of one form of a needle array in the needle rows of a tufting machine constructed in accordance with the present invention.
Figure 4:
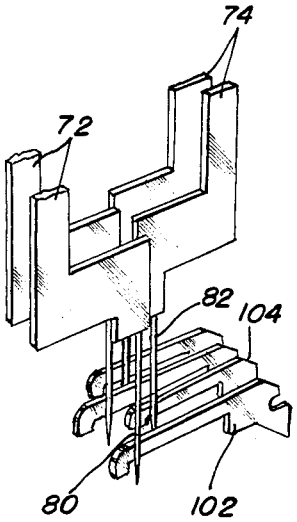
FIG. 4 is a view similar to FIG. 3, but illustrating another needle array in the rows of the tufting machine.

Each needle bar 76, 78 comprises a pair of thin plates sandwiched together with a yarn latch 120 therebetween and when assembled has a step configuration extending inwardly toward the other needle bar or toward the center-line of the machine, i.e., toward the axis of elongation of the push rods and the center of the brackets 50. A respective needle supporting portion 122, 124 is formed inwardly relative to the respective needle holder 72, 74 and extends downwardly relative thereto. The needles 80, 82 are carried in a respective vertical bore within each of the respective supporting portions 122, 124. Thus, the needles carried on each side of the center-line may be closely positioned near the center-line of the machine so that needles 80 on one side of the center-line in one row may be positioned closely to the needles 82 on the other side of the center-line in the other row, the spacing being in the order of approximately ¼ inch, and if the needles 80 in one row are aligned laterally with the needles 82 in the other row, as illustrated in FIG. 3, a plurality of needle pairs are formed and each pair of needles may cooperate with a single hook 88 selectively. If, however, the needle holders, and thus the needles carried thereby, are staggered laterally as illustrated in FIG. 4, each needle 80 may cooperate with a single independent hook 102 selectively, but the gauge between adjacent needles in the lateral direction would be substantially half that of the gauge of the needles when the rows are aligned laterally. Additionally, in the latter instance, the hooks 104 would have shorter bills than the hooks 102. Thus, when the machine is set-up initially with the needles in one row aligned laterally with the needles in the other row, conventional gauges may be obtained, for example, 3/16th spacing, while when the machine is initially set-up with the staggered configuration, the gauge may be, for example, 3/32nds gauge.

The initial spacing configuration may be set-up merely by adjusting the limbs 22 (or 24) on one side of the machine center-line, positioning the needle holders 72 (or 74) on that one side in the guide slots 70 and the slots in the latch carrying bar 26 (or 28) so that the needle holders 72 in the row on that one side of the center-line are laterally disposed intermediate the needle holders 74 in the row on the other side of the center-line. This adjustment may be relatively easily accomplished merely by initially positioning the limbs by means of the adjustment slots 30 prior to positioning the needle holders within the guides. During that initial set up the number of hooks and the spacing therebetween would be determined and the hooks mounted accordingly. For example, if the selected configuration is aligned rows of needles, then only half of the number of hooks, those with the longer bills, would be required relative to the number necessary when the needles are staggered. It is preferred that only the actually required number of hooks be utilized rather than "dry running" alternate or half the hooks when in the aligned configuration.

In the operation of the tufting machine, whether in the aligned needle configuration with the needles in one row aligned with the needles in the other row, or in the staggered needle configuration with the needles in one row offset laterally intermediate the needles in the other row, the push rods 14 are constantly driven reciprocably and drive both latch carrying air cylinder bars 26, 28 by means of their connection to the yoke members. The pattern control 46 may be programmed with a pattern that selectively will allow air to enter any of the air cylinders 34 to extend its latch pin 36 to engage the recess 77 of any of the respective needle holders 72, 74 to thereby couple the bars 26, 28 to the selected needle holder to reciprocably drive the same. Since every needle holder, and thus every needle, has a corresponding coupling pin any needle may be selected to reciprocate during each cycle, while those which are not selected merely sit idle with the needle holder held in the raised position against the respective stop bars 92, 94 by either springs or the magnets 97, 98.

When the machine is configured with the needles in the aligned configuration either needle holder 72, 74 in an aligned pair of the two rows may be selectively coupled to the respective latch carrying bar 26, 28, or both needle holders 72, 74 of the aligned pair may be selected or neither needle holder of the aligned pair may be selected to reciprocate. When a needle carried by a selected needle holder pierces the backing material 108, it cooperates with the hook 102 to form a tufted loop of pile which is subsequently cut by the knife 106. In the aligned needle configuration a single hook cooperates with each pair of needles to seize a loop from either or both needles 80, 82 as they reciprocate selectively. Thus, if the needles of an aligned pair are threaded with different yarns, e.g., different color yarns, either color may be selected for insertion into the backing material, or both colors may be selected, or neither color may be selected at the particular location. Since the needles in the two rows are spaced apart by a small distance of approximately ¼ inch, if both needles 80, 82 are selected the tufted colors would be spaced in the same line but approximately ¼ inch apart and if the feed rate of the backing material through the machine is selected properly this spacing can be incorporated into the pattern. If, on a subsequent stitch, only one of the needles is selected thereby to place only one of the colors into the backing material unique color patterning arrays amongst the multiplicity of needle pairs across the backing material can be devised.

If the tufting machine is initially set-up with the needles in the staggered row configuration, each needle 80, 82 has an individual hook 102, 104 cooperating therewith to form tufts selectively, but in all other respects the operation of the machine is the same as in the aligned rows configuration. However, the gauge is finer with the staggered row configuration, i.e., the spacing between adjacent laterally spaced stitches is closer together. The gauge of the machine in the staggered row configuration may be half that of conventional I.C.N. machine gauges, and of a gauge finer than heretofore known in I.C.N. machines. Thus, when tufting a pattern with the fine gauge configuration aesthetic designs are possible that cannot heretofore be tufted. When overtufting into a pretufted base material, yarn of the prescribed color may be inserted to form the design without visibly showing the base material through the color in the design. For example, various floral patterns and the like may be tufted which are visually appealing, and by threading the needles with various colors in various arrays thereof aesthetic patterns not heretofore available by the tufting process may be produced.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. In a tufting machine having a head for mounting drive means including a push rod reciprocating in a linear path, a bed disposed beneath the head having means for supporting a base material fed in a longitudinal direction normal to said path, apparatus for mounting at least one in each of a pair of respective rows spaced apart in said longitudinal direction and for selective coupling of said needles independently to said push rod for reciprocation therewith, and loop seizing means in said bed for seizing loops of yarn presented by reciprocating needles, said apparatus comprising: a substantially U-shaped yoke having a spanning member and a pair of downwardly depending limbs, means for fastening said spanning member to said push rod, guide means disposed intermediate said limbs, a needle holder corresponding to each needle disposed intermediate said limbs in said guide means, a needle carried by each needle holder, coupling means carried by each of said limbs for reciprocating therewith and for coupling of selective needle holders individually to said limbs for reciprocation therewith to pierce said base material with the corresponding needle and cooperate with said loop seizing means, means for maintaining uncoupled needle holders in a disposition such that needles carried thereby are disposed above said base material, and control means for effecting coupling and uncoupling of said coupling means and said needle holders.

2. In a tufting machine as recited in claim 1, wherein said coupling means comprises a bar fastened to the respective limb, said bar carrying a latch corresponding to each needle adapted to be extended from said bar and be retracted therein in response to said control means, each needle holder having means for receiving a corresponding latch when extended to couple said needle holder to said bar.

3. In a tufting machine as recited in claim 1, wherein said guide means comprises at least one guide member corresponding to each row for guiding needle holders in the respective row.

4. In a tufting machine as recited in claim 3, including support bracket means carried by said head and disposed intermediate said limbs, said guide members being secured to said support bracket means.

5. In a tufting machine as recited in claim 4, wherein said support bracket means comprises at least one laterally extending plate having a pair of planar surfaces facing a respective limb, guide members corresponding to one row being fastened to one surface, and the guide members corresponding to the other row being fastened to the other surface.

6. In a tufting machine as recited in claim 5, wherein each guide member includes vertical slots spaced apart laterally relative to said longitudinal direction, each needle holder being received in a respective slot.

7. In a tufting machine as recited in claim 6, wherein there are two vertically spaced apart guide members secured to each surface of said bracket means, and each needle holder is guided by both guide members.

8. In a tufting machine as recited in claim 7, wherein said coupling means comprises a bar fastened to the respective limb, said bar carrying a latch corresponding to each needle adapted to be extended from said bar and be retracted therein in response to said control means, each needle holder having a notch for receiving a corresponding latch when extended to couple said needle holder to said bar.

9. In a tufting machine as recited in claim 8, wherein said means for mounting uncoupled needle holders comprises magnetic means carried by said head at a disposition adjacent the location where the upper extremity of the needle holders are lifted when the push rods are at top dead center.

10. In a tufting machine as recited in claim 1, wherein each of said rows comprises a multiplicity of needle holders spaced laterally relative to said longitudinal direction and a corresponding needle carried by each needle holder, each needle in one row being aligned laterally with a needle in another row thereby to define a needle pair, and said loop seizing means comprising a hook corresponding to each needle pair for cooperating selectively with either needle, both needles, or neither needle of a corresponding needle pair.

11. In a tufting machine as recited in claim 10, wherein said coupling means comprises a bar fastened to the respective limb, said bar carrying a latch corresponding to each needle adapted to be extended from said bar and be retracted therein in response to said control means, each needle holder having means for receiving a corresponding latch when extended to couple said needle holder to said bar.

12. In a tufting machine as recited in claim 11, wherein said guide means comprises at least one guide member corresponding to each row for guiding needle holders in the respective row.

13. In a tufting machine as recited in claim 12, including support bracket means carried by said head and disposed intermediate said limbs, said guide members being secured to said support bracket means.

14. In a tufting machine as recited in claim 13, wherein said support bracket means comprises at least one laterally extending plate having a pair of planar surfaces facing a respective limb, guide members corresponding to one row being fastened to one surface, and the guide members corresponding to the other row being fastened to the other surface.

15. In a tufting machine as recited in claim 1, wherein each of said rows comprises a multiplicity of needle holders spaced laterally relative to said longitudinal direction and a corresponding needle carried by each needle holder, the needles in one row being offset laterally with respect to the needles in the other row to form staggered needle rows, and said loop seizing means comprising a hook corresponding to each needle for cooperating selectively with the respective needle.

16. In a tufting machine as recited in claim 15, wherein said coupling means comprises a bar fastened to the respective limb, said bar carrying a latch corresponding to each needle adapted to be extended from said bar and be retracted therein in response to said control means, each needle holder having means for receiving a corresponding latch when extended to couple said needle holder to said bar.

17. In a tufting machine as recited in claim 16, wherein said guide means comprises at least one guide member corresponding to each row for guiding needle holders in the respective row.

18. In a tufting machine as recited in claim 17, including support bracket means carried by said head and disposed intermediate said limbs, said guide members being secured to said support bracket means.

19. In a tufting machine as recited in claim 18, wherein said support bracket means comprises at least one laterally extending plate having a pair of planar surfaces facing a respective limb, guide members corresponding to one row being fastened to one surface, and the guide members corresponding to the other row being fastened to the other surface.

20. In a controlled needle tufting machine, means for supporting a base material, a reciprocating latch carrying bar, a needle holder carrying a needle directed toward said base material, means for selectively coupling said needle holder to said latch carrying bar for reciprocating said needle to pierce said workpiece, stop means spaced above said needle holder, said needle holder having at least an upper end comprising magnetic material, and a permanent magnet carried by said stop means for urging and holding said needle holder in a raised position determined by said stop means when not coupled to said latch carrying bar.

* * * * *